US008526867B2

(12) United States Patent
Cho et al.

(10) Patent No.: US 8,526,867 B2
(45) Date of Patent: Sep. 3, 2013

(54) IMAGE FORMING APPARATUS AND CONTROL METHOD THEREOF

(75) Inventors: Hyun Ki Cho, Hanam-si (KR); Sung Dae Kim, Suwon-si (KR); Bong-Hwan Choi, Suwon-si (KR); Seok Heon Chae, Hwaseong-si (KR); Sung Hoon Lim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 334 days.

(21) Appl. No.: 12/926,056

(22) Filed: Oct. 22, 2010

(65) Prior Publication Data

US 2011/0097119 A1 Apr. 28, 2011

(30) Foreign Application Priority Data

Oct. 28, 2009 (KR) ..... 10-2009-102643

(51) Int. Cl.
*G03G 15/01* (2006.01)

(52) U.S. Cl.
USPC ..... 399/301; 399/49; 399/72

(58) Field of Classification Search
USPC ..... 399/49, 72, 301
See application file for complete search history.

(56) References Cited

U.S. PATENT DOCUMENTS

2007/0242986 A1* 10/2007 Matsuyama et al. ..... 399/301

FOREIGN PATENT DOCUMENTS

| | | |
|---|---|---|
| JP | 10-78734 | 3/1998 |
| JP | 2006-47920 | 2/2006 |
| JP | 2006-84812 | 3/2006 |

* cited by examiner

*Primary Examiner* — Hoang Ngo
(74) *Attorney, Agent, or Firm* — Staas & Halsey LLP

(57) ABSTRACT

To restrict a period velocity change of a photoconductor that is an immediate cause of a color registration error, a gap change of a color registration error detection pattern caused by a linear velocity change of the photoconductor is acquired and a linear velocity change of the photoconductor is reduced based on a relationship between the gap change and a velocity of a motor, whereby a reduced color registration error is accomplished.

22 Claims, 10 Drawing Sheets

IMAGE FORMING APPARATUS AND CONTROL METHOD THEREOF

CROSS-REFERENCE TO RELATED APPLICATIONS

This application claims the benefit of Korean Patent Application No. 2009-0102643, filed on Oct. 28, 2009 in the Korean Intellectual Property Office, the disclosure of which is incorporated herein by reference.

BACKGROUND

1. Field

Embodiments relate to an image forming apparatus and a control method thereof, which reduce a velocity change of a photoconductor, thereby achieving a reduced color registration error.

2. Description of the Related Art

Generally, an image forming apparatus is devised to form a color image, in which an electrostatic latent image is formed on a photoconductor as light scans the photoconductor that has been charged with a predetermined electric potential and, after the electrostatic latent image is developed using a desired color of toner, a developed toner image is transferred and fused to a sheet of paper.

An image forming apparatus contains various colors of toner, such as, e.g., Cyan, Magenta, Yellow, and Black toners, to realize a sense of color corresponding to input print data by color combination of the different colors of toner, whereby the image forming apparatus may print various colors of images. Differently from black-and-white printing, several colors may overlap one another on a surface during color printing. When printing a surface using several colors, various reasons may make it difficult to print each color at an accurate position, causing a color registration error. The color registration error may be confirmed via test printing of a color registration error detection pattern.

A photoconductor is not completely spherical and thus, has a periodic velocity change. There are several reasons behind such periodic velocity change, such as, e.g., a shape error as well as alignment and installation errors of the photoconductor, and structural and operational errors of a gear or a coupling connected to the photoconductor. The period velocity change of the photoconductor may be an immediate cause of the color registration error.

Accordingly, to minimize the periodic velocity change of the photoconductor so as to reduce the color registration error, it has been conventionally attempted to eliminate structural instability of the photoconductor, or to control, e.g., a tolerance of a gear member connected to the photoconductor.

However, since there is a limit to rotate the photoconductor at a constant velocity even if the structural instability is eliminated to some extent, it may be difficult to reduce the color registration error.

SUMMARY

Therefore, it is an aspect to provide an image forming apparatus and a control method thereof, which restrict a periodic velocity change of a photoconductor by changing a velocity of a motor used to rotate the photoconductor, thereby achieving a reduced color registration error.

Additional aspects will be set forth in part in the description which follows and, in part, will be apparent from the description, or may be learned by practice of the invention.

In accordance with one aspect, an image forming apparatus includes an image forming unit to form a color registration error detection pattern on a photoconductor, a transfer unit to transfer the color registration error detection pattern formed on the photoconductor to a transfer belt, a pattern sensing unit to sense the color registration error detection pattern transferred to the transfer belt, a motor drive unit to drive a motor used to rotate the photoconductor, and a control unit to ascertain a gap change of the color registration error detection pattern, which denotes a periodic velocity change of the photoconductor, by sensing the color registration error detection pattern transferred to the transfer belt, and to change a velocity of the motor according to the gap change to reduce the periodic velocity change of the photoconductor.

The image forming apparatus may further include a home-position sensing unit to sense a home-position of the photoconductor, and the control unit may form the color registration error detection pattern on the photoconductor on the basis of a time when the home-position of the photoconductor is sensed.

The photoconductor may have a home-position detection protrusion used to detect the home-position of the photoconductor, and the home-position sensing unit may sense the home-position of the photoconductor using the home-position detection protrusion.

A length of the color registration error detection pattern may be an integer multiple of a circumferential length of the photoconductor.

If the home-position of the photoconductor is sensed while changing the velocity of the motor according to the gap change, the motor velocity change may be reset and restarted by the motor, to prevent error accumulation.

The control unit may perform the ascertainment of the gap change, caused by the periodic velocity change of the photoconductor, after power on or off, after exchange or reinstallation of a developing device including the photoconductor, and/or after printing of predetermined number of recording media.

The control unit may calculate a motor velocity function in the form of a sine function corresponding to the gap change after the ascertainment of the gap change, and may change the velocity of the motor according to the motor velocity function.

The control unit may limit a phase of the motor velocity function so as to be less than ⅛ of a rotation cycle of the photoconductor.

A plurality of photoconductors may be provided, on which color registration error detection patterns of different colors are formed respectively, a plurality of motors may be provided to rotate the plurality of photoconductors respectively, and the control unit may individually rotate the plurality of photoconductors.

The control unit may perform an Auto Color Registration (ACR) operation for the respective color registration error detection patterns of different colors formed on the plurality of photoconductors and thereafter, may perform an ACR operation for overlapped color images of the color registration error detection patterns transferred to the transfer belt.

In accordance with another aspect, a control method of an image forming apparatus includes forming a color registration error detection pattern on a photoconductor, transferring the color registration error detection pattern formed on the photoconductor to a transfer belt, sensing the color registration error detection pattern transferred to the transfer belt, ascertaining a gap change of the color registration error detection pattern, which denotes a periodic velocity change of the photoconductor, and changing a velocity of a motor used to rotate the photoconductor according to the gap change.

The formation of the color registration error detection pattern on the photoconductor may be performed during constant-velocity driving of the motor.

The formation of the color registration error detection pattern on the photoconductor may be performed on the basis of a time when a home-position of the photoconductor is sensed.

The ascertainment of the gap change from gap differences of the color registration error detection pattern may include estimating the gap change via model fitting of the gap differences.

The change of the velocity of the motor according to the gap change may include calculating a linear velocity function of the photoconductor from the gap change, calculating a motor velocity function from the linear velocity function of the photoconductor, and changing the velocity of the motor according to the motor velocity function.

The linear velocity function of the photoconductor may be represented by the following Equation 1 if the gap change is a sine function: Photoconductor Linear Velocity Function=$Vo+\omega A\cos(\omega t+\theta)$- - - Equation 1. Here, Vo is an average velocity of the photoconductor, A is a change magnitude, $\omega$ is an angular velocity $2\pi f$, f is a velocity change frequency, and $\theta$ is a phase.

The motor velocity function may be represented by the following Equation 2; Motor Velocity Function=$Vm+\omega AVm/Vo*\sin(\omega t+\theta m)$- - - Equation 2. Here, Vm is the velocity of the motor that provides an average velocity of the photoconductor, A is a change magnitude, $\omega$ is an angular velocity $2\pi f$, f is a velocity change frequency, and $\theta m$ is a motor velocity phase.

The motor velocity phase of the motor velocity function may be less than ⅛ of a rotation cycle of the photoconductor.

A plurality of photoconductors may be provided, on which color registration error detection patterns of different colors are formed respectively, and a plurality of motors may be provided to rotate the plurality of photoconductors respectively, and the control method may further include individually rotating the plurality of photoconductors when the color registration error detection patterns are formed on the plurality of photoconductors.

The control method may further include performing an Auto Color Registration (ACR) operation for the respective color registration error detection patterns of different colors formed on the plurality of photoconductors and thereafter, performing an ACR operation for overlapped color images of the color registration error detection patterns transferred to the transfer belt.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
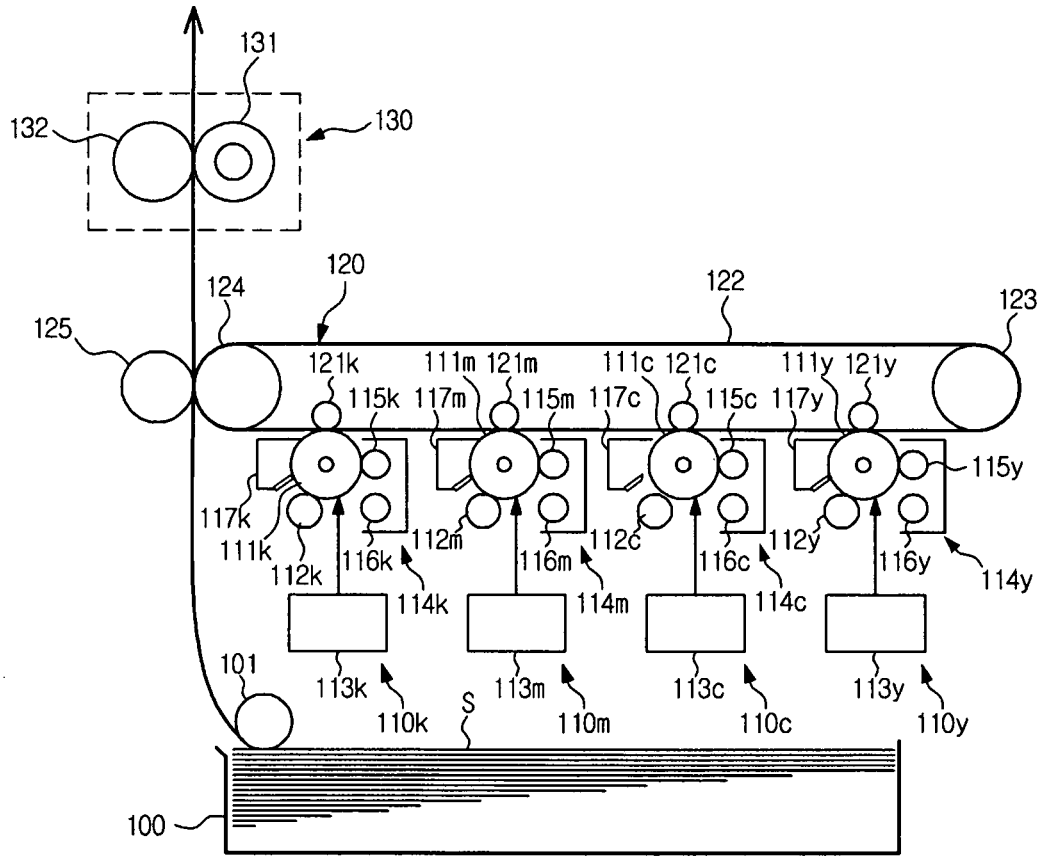
FIG. 1 is a schematic configuration view of an image forming apparatus according to an exemplary embodiment.

Reference will now be made in detail to the embodiments, examples of which are illustrated in the accompanying drawings, wherein like reference numerals refer to like elements throughout.

FIG. 1 illustrates a schematic configuration of an image forming apparatus according to an exemplary embodiment.

As shown in FIG. 1, the image forming apparatus according to the exemplary embodiment includes a paper supply unit 100, image forming units 110*k*, 110*m*, 110*c* and 110*y*, a transfer unit 120, and a fusing unit 130.

The paper supply unit 100 serves to supply recording media S, such as paper, etc. The recording media S loaded in a paper supply cassette is picked up and delivered by a pickup roller 112.

The image forming units 110*k*, 110*m*, 110*c* and 110*y* are arranged above the paper supply unit 100, and serve to form developer images of different colors, such as Black, Magenta, Cyan and Yellow developer images, on a recording medium S.

The image forming units 110*k*, 110*m*, 110*c* and 110*y* include first, second, third and fourth photoconductors 111*k*, 111*m*, 111*c* and 111*y* respectively. Starting from the left side of the drawing, the first, second, third and fourth photoconductors 111*k*, 111*m*, 111*c* and 111*y* are horizontally spaced apart from one another by a predetermined distance to face an intermediate transfer belt 122 of the transfer unit 120. The first, second, third and fourth photoconductors 111*k*, 111*m*, 111*c* and 111*y* are arranged to come into contact with the intermediate transfer belt 122 under the influence of a constant pressure applied by first, second, third and fourth transfer rollers 121*k*, 121*m*, 121*c* and 121*y* of the transfer unit 120, so as to define nips with the intermediate transfer belt 122. The first, second, third and fourth photoconductors 111*k*, 111*m*, 111*c* and 111*y* are rotated counterclockwise by gear members that receive power from motors.

Provided around the first, second, third and fourth photoconductors 111*k*, 111*m*, 111*c* and 111*y* are, e.g., first, second, third and fourth chargers 112*k*, 112*m*, 112*c* and 112*y*, first, second, third and fourth light scanners 113*k*, 113*m*, 113*c* and 113*y*, and first, second, third and fourth developing devices 114*k*, 114*m*, 114*c* and 114*y*.

The first, second, third and fourth chargers 112*k*, 112*m*, 112*c* and 112*y* take the form of charging rollers and are arranged to come into contact with surfaces of the first, second, third and fourth photoconductors 111*k*, 111*m*, 111*c* and 111*y*. When a predetermined charging bias voltage is applied to the first, second, third and fourth chargers 112*k*, 112*m*,

112*c* and 112*y*, the first, second, third and fourth chargers 112*k*, 112*m*, 112*c* and 112*y* charge the surfaces of the first, second, third and fourth photoconductors 111*k*, 111*m*, 111*c* and 111*y* with a predetermined electric potential, for example, about −600V assuming that negative polarity developers are used.

The first, second, third and fourth light scanners 113*k*, 113*m*, 113*c* and 113*y* serve to irradiate light, i.e. laser beam to the surfaces of the first, second, third and fourth photoconductors 111*k*, 111*m*, 111*c* and 111*y*, which have been charged by the first, second, third and fourth chargers 112*k*, 112*m*, 112*c* and 112*y*, according to image signals input from a computer, scanner, etc., thereby forming electrostatic latent images having a lower electric potential, for example, about −50V than the charging electric potential. Configurations of the first, second, third and fourth light scanners 113*k*, 113*m*, 113*c* and 113*y* are identical to generally known configurations and thus, a detailed description thereof will be omitted hereinafter.

The first, second, third and fourth developing devices 114*k*, 114*m*, 114*c* and 114*y* serve to attach corresponding colors of developers to the surfaces of the first, second, third and fourth photoconductors 111*k*, 111*m*, 111*c* and 111*y*, on which the electrostatic latent images have been formed, thereby developing the electrostatic latent images into visible developer images. The first, second, third and fourth developing devices 114*k*, 114*m*, 114*c* and 114*y* respectively include first, second, third and fourth developing rollers 115*k*, 115*m*, 115*c* and 115*y* and first, second, third and fourth developer supply rollers 116*k*, 116*m*, 116*c* and 116*y*.

The first, second, third and fourth developing rollers 115*k*, 115*m*, 115*c* and 115*y* are rotated while being engaged with the first, second, third and fourth photoconductors 111*k*, 111*m*, 111*c* and 111*y*, serving to attach the developers to the electrostatic latent images of the first, second, third and fourth photoconductors 111*k*, 111*m*, 111*c* and 111*y* so as to develop the electrostatic latent images into the visible developer images. The first, second, third and fourth developing rollers 115*k*, 115*m*, 115*c* and 115*y* are arranged close to the surfaces of the first, second, third and fourth photoconductors 111*k*, 111*m*, 111*c* and 111*y* and are rotated clockwise by power transmission gears connected to the gear members that are used to drive the photoconductors 111*k*, 111*m*, 111*c* and 111*y*. The first, second, third and fourth developing rollers 115*k*, 115*m*, 115*c* and 115*y* are adapted to receive a predetermined developing bias voltage lower than that applied to the first, second, third and fourth developer supply rollers 116*k*, 116*m*, 116*c* and 116*y* by 100~400V. For example, a voltage of −250V is applied to the first, second, third and fourth developing rollers 115*k*, 115*m*, 115*c* and 115*y*.

The first, second, third and fourth developer supply rollers 116*k*, 116*m*, 116*c* and 116*y* serve to supply the developers to the first, second, third and fourth developing rollers 115*k*, 115*m*, 115*c* and 115*y* using an electric potential difference with the first, second, third and fourth developing rollers 115*k*, 115*m*, 115*c* and 115*y*. The first, second, third and fourth developer supply rollers 116*k*, 116*m*, 116*c* and 116*y* come into contact with lower side portions of the first, second, third and fourth developing rollers 115*k*, 115*m*, 115*c* and 115*y*, to define nips with the first, second, third and fourth developing rollers 115*k*, 115*m*, 115*c* and 115*y*. Black, Magenta, Cyan and Yellow developers are fed to a lower space between the first, second, third and fourth developer supply rollers 116*k*, 116*m*, 116*c* and 116*y* and the first, second, third and fourth developing rollers 115*k*, 115*m*, 115*c* and 115*y*.

The first, second, third and fourth developer supply rollers 116*k*, 116*m*, 116*c* and 116*y* are adapted to receive a predetermined developer supply bias voltage higher than that applied to the first, second, third and fourth developing rollers 115*k*, 115*m*, 115*c* and 115*y* by 100~400V. For example, a voltage of −500V is applied to the first, second, third and fourth developer supply rollers 116*k*, 116*m*, 116*c* and 116*y*. Accordingly, as the developers, which are fed to the lower space between the first, second, third and fourth developer supply rollers 116*k*, 116*m*, 116*c* and 116*y* and the first, second, third and fourth developing rollers 115*k*, 115*m*, 115*c* and 115*y*, are electrically charged by the first, second, third and fourth developer supply rollers 116*k*, 116*m*, 116*c* and 116*y* via charge injection, the developers are attached to the first, second, third and fourth developing rollers 115*k*, 115*m*, 115*c* and 115*y* having a relatively lower electric potential, thereby being moved to the nips between the first, second, third and fourth developer supply rollers 116*k*, 116*m*, 116*c* and 116*y* and the first, second, third and fourth developing rollers 115*k*, 115*m*, 115*c* and 115*y*.

After the first, second, third and fourth photoconductors 111*k*, 111*m*, 111*c* and 111*y* are rotated one cycle, first, second, third and fourth cleaners 117*k*, 117*m*, 117*c* and 117*y* clean waste developer remaining on the surfaces of the photoconductors 111*k*, 111*m*, 111*c* and 111*y*.

The transfer unit 120 includes the first, second, third and fourth transfer rollers 121*k*, 121*m*, 121*c* and 121*y*, the intermediate transfer belt 122, and a final transfer roller 125. The first, second, third and fourth transfer rollers 121*k*, 121*m*, 121*c* and 121*y* transfer the developer images formed on the first, second, third and fourth photoconductors 111*k*, 111*m*, 111*c* and 111*y* to the intermediate transfer belt 122 and in turn, the images of the intermediate transfer belt 122 are transferred to the recording medium S fed from the paper supply unit 100 as the recording medium S passes between the final transfer roller 125 and the intermediate transfer belt 122.

The intermediate transfer belt 122 is wound on a drive roller 123 and a supporting roller 124, which are horizontally spaced apart from each other while coming into contact with an inner surface of the intermediate transfer belt 122. The intermediate transfer belt 122 is adapted to travel in a direction starting from the first developing device 114*k* to the fourth developing device 114*y*.

The first, second, third and fourth transfer rollers 121*k*, 121*m*, 121*c* and 121*y* serve as transfer-voltage applying members to apply a predetermined transfer bias voltage to the intermediate transfer belt 122 and are respectively arranged inside the intermediate transfer belt 122 so as to press the intermediate transfer belt 122 against the first, second, third and fourth photoconductors 111*k*, 111*m*, 111*c* and 111*y* by a predetermined pressure. The first, second, third and fourth transfer rollers 121*k*, 121*m*, 121*c* and 121*y* are also adapted to receive the predetermined transfer bias voltage.

The final transfer roller 125 is arranged to face the intermediate transfer belt 122. The final transfer roller 125 is spaced apart from the intermediate transfer belt 122 while the developer images are being transferred to the intermediate transfer belt 122, but comes into contact with the intermediate transfer belt 122 by a predetermined pressure when the developer images are completely transferred to the intermediate transfer belt 122. The predetermined transfer bias voltage is applied to the final transfer roller 125, so that the developer images transferred to the intermediate transfer belt 122 are transferred to the recording medium S.

The fusing unit 130 serves to fuse the developer images transferred to the recording medium S, and includes a heating roller 131 and a press roller 132. The heating roller 131 contains a heater therein to fuse the developer images onto the recording medium S at a high temperature.

The press roller 132 is compressed against the heating roller 131 by an elastic pressure member, thus acting to press the recording medium S.

Figure 2:
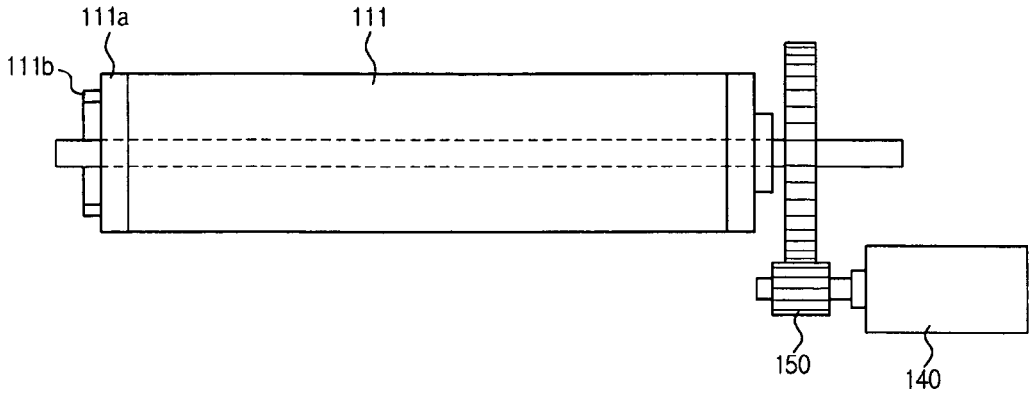
FIG. 2 is a view illustrating connection of a photoconductor and a motor provided in the image forming apparatus according to the exemplary embodiment.

Referring to FIG. 2, a photoconductor 111 of the image forming apparatus is provided at one end thereof with a drive gear 111*a*.

A motor 140 to generate drive power required to rotate the photoconductor 111 is coupled to the drive gear 111*a* with a gear member 150 interposed therebetween.

The gear member 150, connected to both the photoconductor 111 and the motor 140, transmits drive power of the motor 140 to the photoconductor 111, allowing the photoconductor 111 to be rotated.

The drive gear 111*a* has a home-position detection protrusion 111*b* to detect a home-position of the photoconductor 111. The home-position detection protrusion 111*b* has an arched shape.

Figure 3:
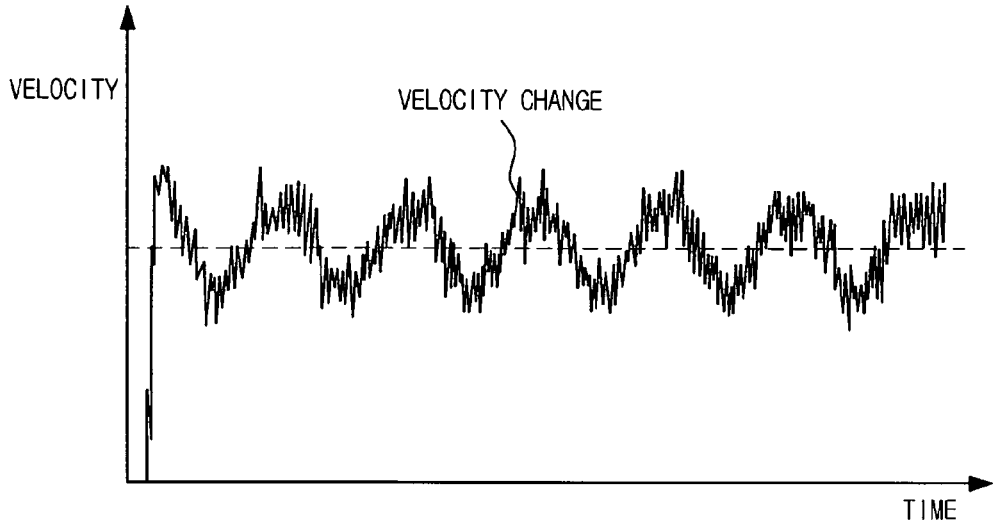
FIG. 3 is a graph illustrating a velocity change of the photoconductor during constant-velocity rotation of the motor in the image forming apparatus according to the exemplary embodiment.

As shown in FIG. 3, the photoconductor 111 has a periodic velocity change. The velocity change of the photoconductor 111 causes a gap change of the color registration error detection pattern to be transferred to the intermediate transfer belt 122. Generally, the gap change has a sinusoidal form due to characteristics of the period velocity change.

To understand a relationship between a velocity change of the photoconductor 111 and a gap change of the color registration error detection pattern caused by the velocity change, the gap change may be represented by a sine wave as follows:

$$\text{Gap Change}=A\sin(\omega t+\theta) \qquad \text{Eq. 1}$$

Here, A is a position change magnitude, ω is an angular velocity 2πf, f is a velocity change frequency, and θ is a phase.

The gap change is caused by a linear velocity change of the photoconductor 111 and thus, a linear velocity of the photoconductor 111 may be represented as follows:

$$\text{Linear Velocity of Photoconductor}=Vo+\omega A\cos(\omega t+\theta) \qquad \text{Eq. 2}$$

Here, Vo is an average velocity of the photoconductor.

Since a linear velocity change magnitude of the photoconductor Av is ωA, the position change magnitude may be represented as follows:

$$\text{Position Change Magnitude } A=Av/\omega=Av/(2\pi f) \qquad \text{Eq. 3}$$

Figure 4:
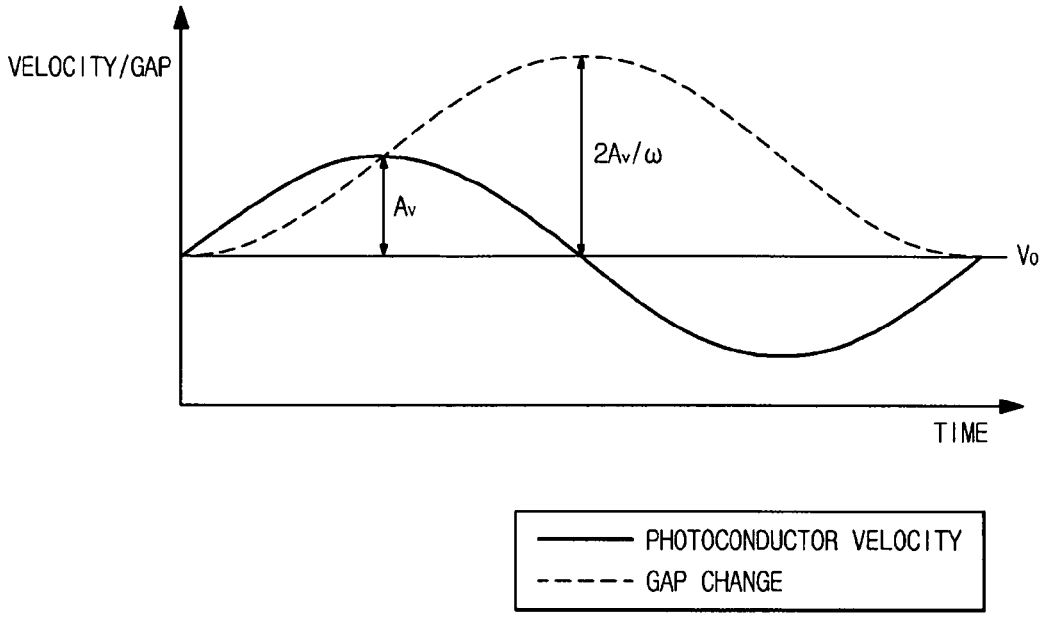
FIG. 4 is a graph illustrating a relationship between the velocity change of the photoconductor and a position change of a color registration error detection pattern in the image forming apparatus according to the exemplary embodiment.

As shown in FIG. 4, it will be appreciated from the above equations that the gap change is proportional to the velocity change magnitude and is inversely proportional to the velocity change frequency. In other words, the greater the velocity change of the photoconductor 111 or the smaller the velocity change frequency, the greater the gap change. Therefore, to reduce the gap change, it may be necessary to reduce the velocity change of the photoconductor 111.

Figure 5:
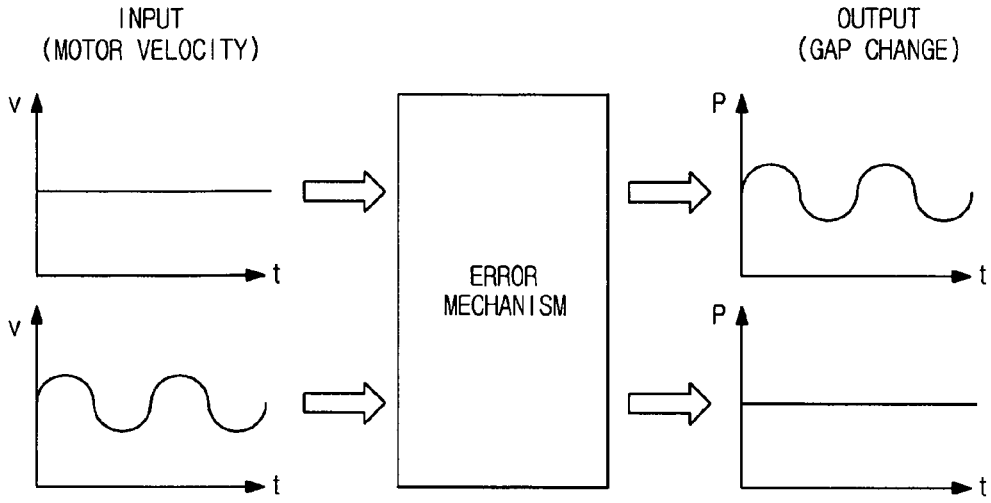
FIG. 5 is a view illustrating a concept to restrict the position change caused by the velocity change of the photoconductor in the image forming apparatus according to the exemplary embodiment.

As shown in FIG. 5, even if the motor 140 generally provides a constant rotation force, an error mechanism may be generated via several transmission processes, finally causing a color'registration error. On the other hand, the gap change may be reduced by appropriately controlling a velocity of the motor in a variable manner based on the relationship between the gap change of the color registration error detection pattern and the velocity of the motor 140.

Accordingly, in the present exemplary embodiment, to restrict an intrinsic periodic velocity change of the rotating photoconductor 111 that is an immediate cause of a color registration error, it may be necessary to ascertain the gap change of the color registration error detection pattern caused by the linear velocity change of the photoconductor 111. By reducing the linear velocity change of the photoconductor 111 based on the relationship between the gap change and the velocity of the motor, it may be possible to reduce the color registration error.

Figure 6:
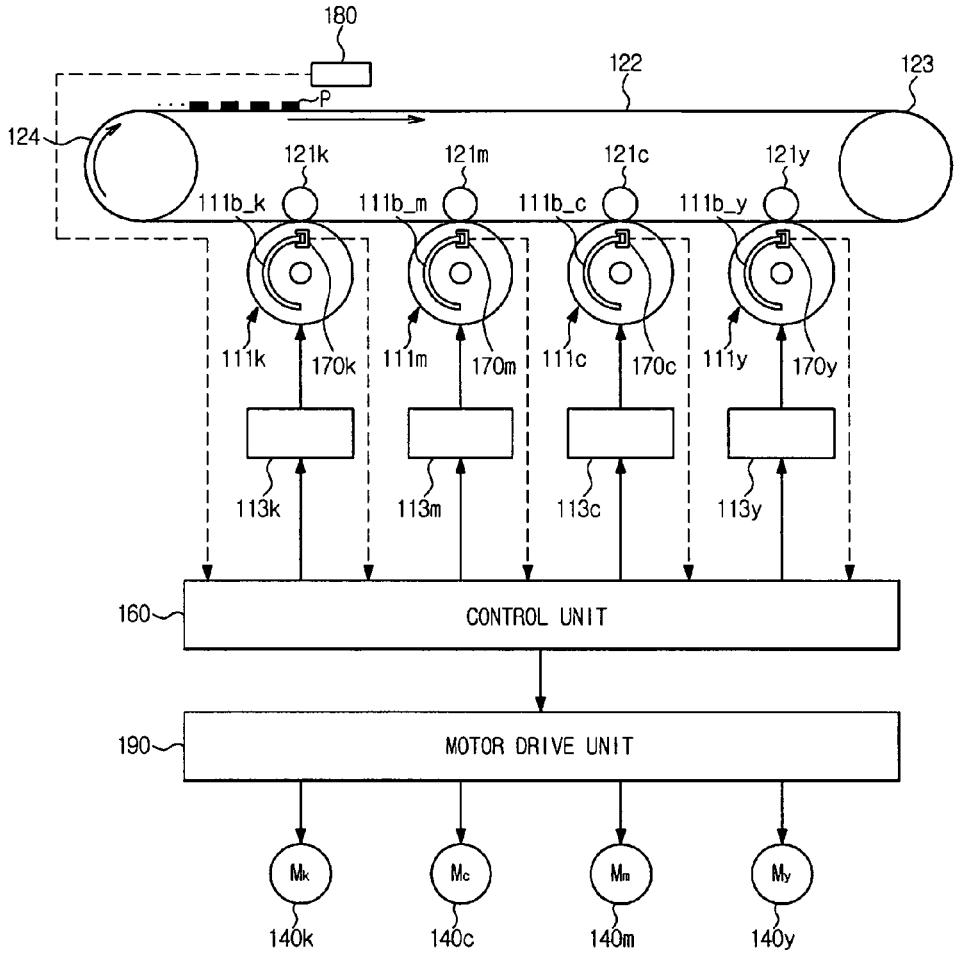
FIG. 6 is a schematic control block diagram of the image forming apparatus according to the exemplary embodiment.

FIG. 6 is a schematic control block diagram of the image forming apparatus according to the exemplary embodiment.

As shown in FIG. 6, the image forming apparatus according to the exemplary embodiment includes a control unit 160 to perform general control operations, four home-position sensing units 170*k*, 170*m*, 170*c* and 170*y* to sense home-positions of the respective photoconductors 111*k*, 111*m*, 111*c* and 111*y*, a single pattern sensing unit 180 to sense the color registration error detection patterns P transferred to the intermediate transfer belt 122 by the respective photoconductors 111*k*, 111*m*, 111*c* and 111*y*, and a motor drive unit 190 to individually drive motors 140*k*, 140*m*, 140*c* and 140*y* corresponding to the respective photoconductors 111*k*, 111*m*, 111*c* and 111*y*.

The home-position sensing units 170*k*, 170*m*, 170*c* and 170*y* are photo sensors, and are provided at a side of the drive gear 111*a* connected to the respective photoconductors 111*k*, 111*m*, 111*c* and 111*y* to sense positions of home-position detection protrusions 111*b*_k, 111*b*_m, 111*b*_c and 111*b*_y, so as to sense home-positions of the respective photoconductors 111*k*, 111*m*, 111*c* and 111*y*.

The pattern sensing unit 180 includes a Color Toner Density (CTD) sensor. The pattern sensing unit 180 irradiates infrared light to the color registration error detection patterns P of the respective photoconductors 111*k*, 111*m*, 111*c* and 111*y* transferred to the intermediate transfer belt 122, and senses an intensity of light reflected from the color registration error detection patterns P or a non-patterned region.

The control unit 160 forms the color registration error detection patterns P of the respective photoconductors 111*k*, 111*m*, 111*c* and 111*y* on the corresponding photoconductors 111*k*, 111*m*, 111*c* and 111*y* using the corresponding light scanners 113*k*, 113*m*, 113*c* and 113*y*, and transfers the color registration error detection patterns P formed on the corresponding photoconductors 111*k*, 111*m*, 111*c* and 111*y* to the intermediate transfer belt 122.

In addition, the control unit 160 senses the color registration error detection patterns P of the respective photoconductors 111*k*, 111*m*, 111*c* and 111*y* transferred to the intermediate transfer belt 122, and ascertains a gap change of the respective color registration error detection patterns P that denotes a periodic velocity change of the corresponding photoconductors 111*k*, 111*m*, 111*c* and 111*y*.

To reduce the periodic velocity change of the corresponding photoconductors 111*k*, 111*m*, 111*c* and 111*y*, the control unit 160 changes a velocity of the corresponding motors 140*k*, 140*m*, 140*c* and 140*y* according to the gap change.

In this case, to reduce the color registration error using the gap change caused by the linear velocity change of the photoconductor 111, the control unit 160 sequentially changes the velocity of the respectively photoconductors 111*k*, 111*m*, 111*c* and 111*y* by individually driving the respective motors 140*k*, 140*m*, 140*c* and 140*y*.

Figure 7:
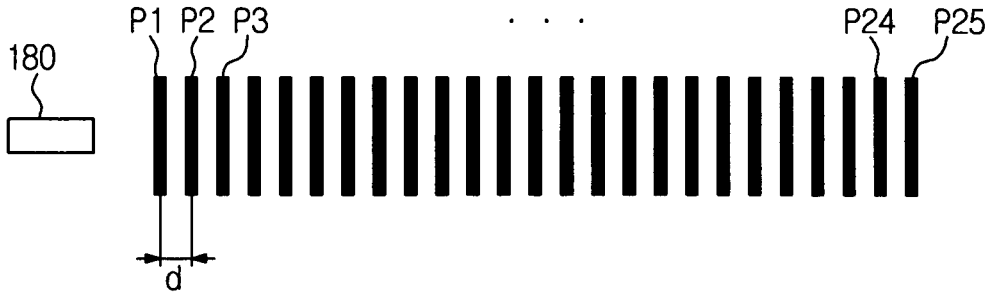
FIG. 7 is a view illustrating a color registration error detection pattern to detect the position change caused by the velocity change of the photoconductor shown in FIG. 6.

As shown in FIG. 7, to understand the gap change caused by the velocity change of the photoconductor 111, the color registration error detection pattern P transferred to the intermediate transfer belt 122 consists of a plurality of bar-shaped patterns P1 to P25. The bar-shaped patterns are designed to have the same thickness and the same gap d.

The color registration error detection pattern has a length corresponding to an integer multiple of a circumferential length of the photoconductor. This may effectively assure stable data acquisition and increased error fitting accuracy.

The control unit 160 forms Black, Magenta, Cyan and Yellow patterns for the respective photoconductors 111*k*, 111*m*, 111*c* and 111*y* and transfers these patterns to the intermediate transfer belt 122.

In addition, the control unit 160 repeatedly transfers the color registration error detection patterns P of the respective photoconductors 111*k*, 111*m*, 111*c* and 111*y* to the intermediate transfer belt 122 one or more times. This enables more accurate data detection and removes an unexpected value. When the respective color registration error detection patterns P are repeatedly transferred one or more times, the control unit 160 forms the color registration error detection patterns P on the respective photoconductors 111*k*, 111*m*, 111*c* and 111*y* at a same time on the basis of the home-positions of the photoconductors 111*k*, 111*m*, 111*c* and 111*y*. Although this will be described hereinafter, the control unit 160 acquires a gap change function by fitting the gap change caused by the periodic linear velocity change of the respective photoconductors 111*k*, 111*m*, 111*c* and 111*y* to a sine function and then, acquires a motor velocity function using the gap change function. As the control unit 160 changes the velocity of the respective motors 140*k*, 140*m*, 140*c* and 140*y* based on the motor velocity function, the control unit 160 may restrict the velocity change of the photoconductors 111*k*, 111*m*, 111*c* and 111*y*, thereby significantly reducing a color registration error.

Hereinafter, for convenience of description, processes to acquire a gap change of the color registration error detection pattern P for the single photoconductor 111, to acquire a motor velocity change for reduction of a velocity change of the photoconductor 111 based on the gap change, and to change a velocity of the motor 140 according to the motor velocity change will be described.

Figure 8:
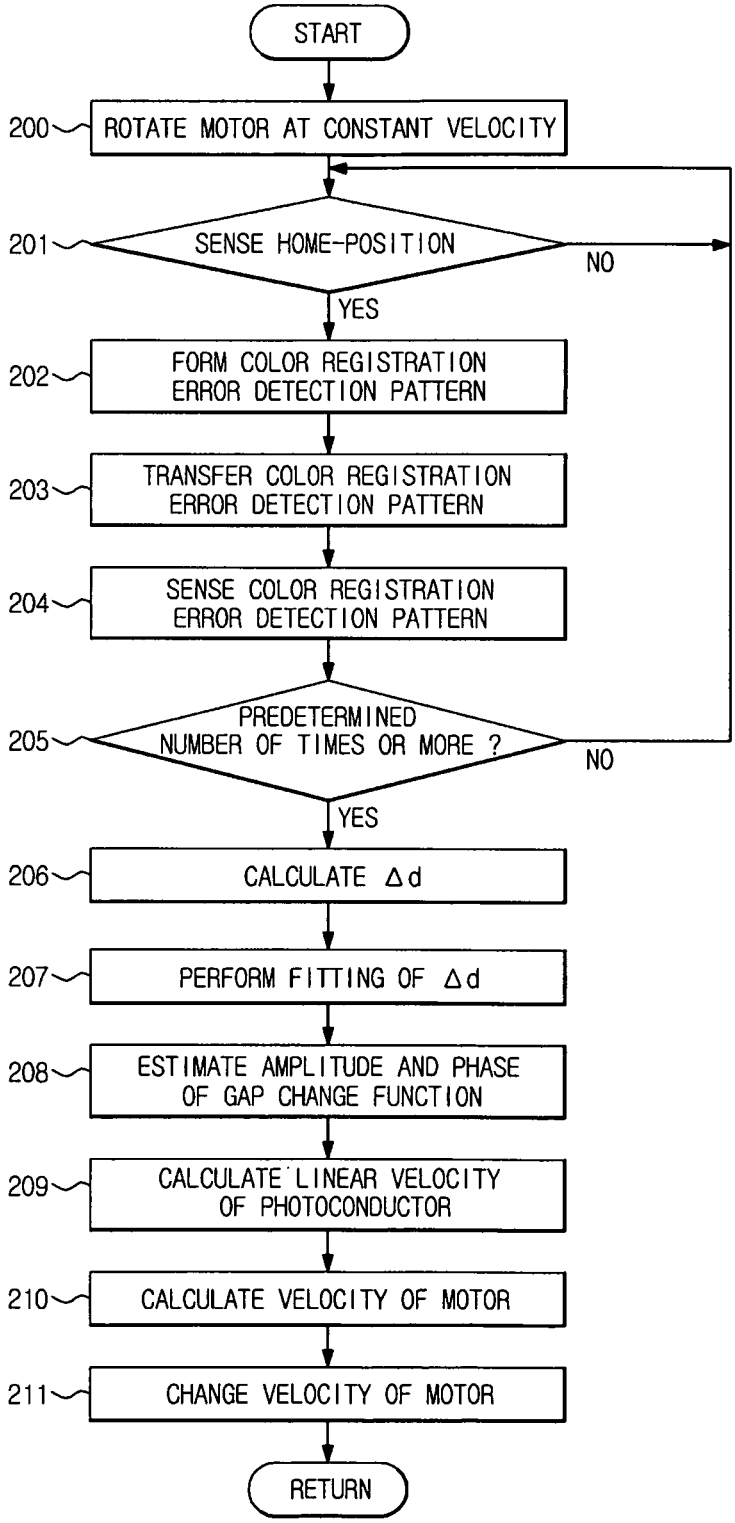
FIG. 8 is a control flow chart schematically illustrating a control method of the image forming apparatus according to the exemplary embodiment.

FIG. 8 illustrates an Auto Color Registration (ACR) operation for an image formed on the photoconductor of the image forming apparatus according to the exemplary embodiment.

Referring to FIG. 8, the image forming apparatus according to the exemplary embodiment performs an operation 200 to drive the motor 140 at a constant velocity, an operation 201 to confirm whether or not a home-position of the photoconductor 111 is sensed, an operation 202 to form the color registration error detection pattern P on the photoconductor 111, an operation 203 to transfer the color registration error detection pattern P formed on the photoconductor 111 to the intermediate transfer belt 122, an operation 204 to sense the color registration error detection pattern P transferred to the intermediate transfer belt 122, an operation 205 to determine whether or not the above operations 200 to 204 are repeatedly performed a predetermined number of times or more, an operation 206 to calculate a gap difference Δd between the bar-shaped patterns of the color registration error detection pattern P if implementation of the operations 200 to 204 is determined to have been performed a predetermined number of times or more, an operation 207 to fit the calculated gap difference Δd of the color registration error detection pattern P using model fitting to approximate the gap difference Δd to a sine function, an operation 208 to estimate an amplitude and a phase of a gap change function via the fitting operation, an operation 209 to calculate a linear velocity of the photoconductor 111 using the estimated amplitude and phase of the gap change function, an operation 210 to calculate a velocity of the motor 140 using the calculated linear velocity of the photoconductor 111, and an operation 211 to change the velocity of the motor 140 based on the calculated velocity of the motor 140. With implementation of the above described operations, the image forming apparatus may restrict the velocity change of the photoconductor 111, thereby achieving a significantly reduced color registration error.

Considering the above described respective operations in more detail, if the color registration error detection pattern P is formed on each photoconductor 111 at a predetermined time on the basis of the home-position of the photoconductor 111 and then, is transferred to the intermediate transfer belt 122, the pattern sensing unit 180 senses the color registration error detection pattern P. It is noted that this operation is repeated a predetermined number of times (e.g., four times) for the respective photoconductors 111 and that the formation of the respective color registration error detection patterns P is accomplished at a same time on the basis of the home-positions of the respective photoconductors 111. This is due to the fact that different gap change phases may occur every time if the formation of the color registration error detection patterns P is not accomplished at a same time.

Figure 9:
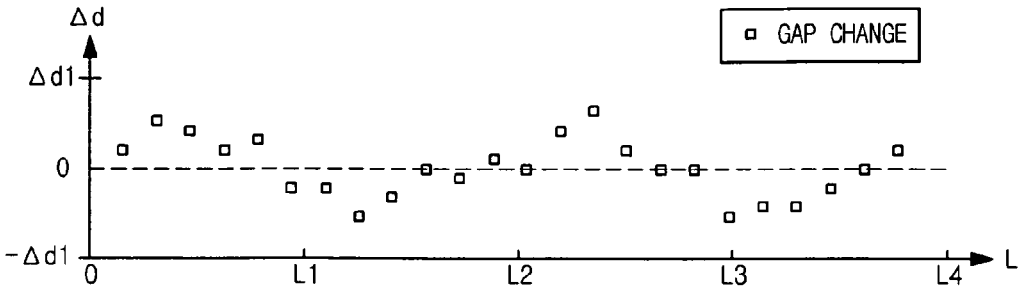
FIG. 9 is a graph illustrating a gap change of the pattern of FIG. 7.

Since the color registration error detection pattern P consists of the bar-shaped patterns having the same thickness and the same gap and the photoconductor 111 has a periodic velocity change, the bar-shaped patterns formed on the photoconductor 111 may exhibit a gap change according to the velocity change of the photoconductor 111. The gap change may be sensed using the pattern sensing unit 180. Gap differences at different positions of the photoconductor 111 are fitted to a sine function and finally may be represented by a gap change function. As shown in FIG. 9, the respective gap changes are obtained by subtracting an original pattern gap from the sensed pattern gap.

Figure 10:
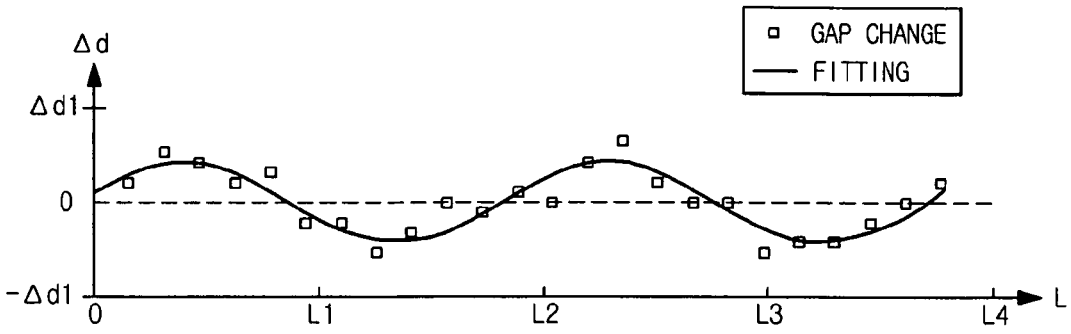
FIG. 10 is a graph illustrating fitting of a gap change of the pattern of FIG. 7.

The gap differences of the bar-shaped patterns are fitted using a sine function $A \sin((\omega x/Vo+\theta)$. An optimal fitting result as shown in FIG. 10 may be obtained by establishing values of A and θ within respectively given ranges of $0 \leqq A \leqq [(\mathrm{Max}(\Delta d)-\mathrm{Min}(\Delta d))/2]$ and $0 \leqq \theta \leqq 2\pi$ to minimize the sum of squared errors, i.e. the sum of the squares of differences between gap differences Δd calculated from the respectively sensed data and the sine function $A \sin(\omega x/Vo+\theta)$.

An average of the four values of θ is calculated only when a difference between a maximum and a minimum of the four values of θ obtained by the above described fitting operation is 90 degrees or less and also, the larger two of four values of A are selected and averaged. The resulting values are recognized as a final magnitude and phase of the gap change function.

After acquiring the gap change, it may be necessary to ascertain a relationship between the gap change and a velocity of the motor, in order to reduce the gap change. The gap change obtained from the color registration error detection pattern P, as shown in FIG. 10, is a periodic change and thus, may be represented by the sine function $A \sin(\omega x/Vo+\theta)$.

Since the above described gap change is caused by the linear velocity change of the photoconductor 111, a linear velocity change of the organic photoconductor (OPC) may be expressed as follows:

$$\text{OPC linear velocity}=Vo+\omega A \cos(\omega t+\theta) \qquad \text{Eq. 4}$$

Here, Vo is an average velocity of the photoconductor.

Finally, the velocity of the motor to be controlled may be expressed as follows:

$$\text{Motor Velocity}=Vm+\omega AVm/Vo*\sin(\omega t+\theta m) \qquad \text{Eq. 5}$$

Here, Vm is a velocity of the motor that provides the average velocity of the photoconductor, and θm is a motor velocity phase.

Accordingly, it will be appreciated that a motor velocity change magnitude is predicted from a gap change magnitude and that a gap change frequency is equal to a motor velocity change frequency.

A relationship between a gap change phase θ and a motor velocity phase θm is as follows:

$$\text{Motor Velocity Phase } \theta m = \text{Gap Change Phase } \theta + 270 \text{ degrees} \quad \text{Eq. 6}$$

Accordingly, by substituting Eq. 6 into Eq. 5, the velocity of the motor is as follows:

$$\text{Motor Velocity} = Vm + \omega AVm/Vo * \sin(\omega t + \theta + 270 \text{ degrees}) \quad \text{Eq. 7}$$

Here, a criterion time of motor control is a time when a home-position of the photoconductor is sensed.

In this case, a range of the motor velocity phase for motor control is as follows:

$$\theta + 225 \text{ degrees} \leqq \theta m \leqq \theta + 315 \text{ degrees}$$

Here, θm is an exemplary value and is less than ⅛ of a rotation cycle of the photoconductor.

Generally, a motor control time point differs from an image forming time point of the color registration error detection pattern P. In other words, although the motor is controlled every time on the basis of the home-position of the photoconductor, the color registration error detection pattern P begins to be formed after a predetermined time passes from a time point when the home-position is sensed. If the image formation of the color registration error detection pattern P begins after passage of a predetermined delay angle Φ on the basis of the home-position, the velocity of the motor may be expressed as follows:

$$\text{Motor Velocity} = Vm + \omega AVm/Vo * \sin(\omega t + \theta + 270 \text{ degrees} - \Phi) \quad \text{Eq. 8}$$

Here, Φ is 360 degrees*Δt/T, Δt is a delay time until the image formation begins on the basis of the home-position, and T is a rotation cycle of the photoconductor.

Once the velocity of the motor is calculated via the above described operation, the motor control begins on the basis of the home-position. In this case, the motor control is reset and restarted whenever the home-position is sensed. More specifically, assuming that the motor control begins at the home-position, a zero time is input whenever the home-position is sensed upon every rotation of the photoconductor 111, rather than the control time t sequentially increasing until the control of the photoconductor 111 ends, whereby the motor control is reset on a per rotation cycle basis of the photoconductor 111. This is because slight errors caused upon every rotation of the photoconductor 111 (i.e. an error caused because a frequency input to the motor does not completely equal to an actual frequency of the photoconductor) may be gradually accumulated, thus increasing a gap change after a predetermined time passes.

An Auto Color Registration (ACR) operation for an image formed on the photoconductor, which restricts a velocity change of the photoconductor by changing the velocity of the motor based on the gap change, is performed upon exchange or reinstallation of the developing unit or the developing device drive unit, upon power on or off, or after printing a predetermined number of recording media.

After completing the ACR operation for the image formed on the photoconductor, an ACR operation to correct positions of the color registration error detection patterns P of different colors overlapped on the intermediate transfer belt 122 is performed. This ACR operation corrects an image alignment error by sensing the color registration error detection patterns P of different colors overlapped on the intermediate transfer belt 122 by use of the pattern sensing unit 180.

As apparent from the above description, according to the exemplary embodiment, to restrict a period velocity change of a photoconductor that is an immediate cause of a color registration error, a gap change of a color registration error detection pattern caused by a linear velocity change of the photoconductor is accurately ascertained and then, an ACR operation for an image formed on the photoconductor is performed to reduce the linear velocity change of the photoconductor based on a relationship between the gap change and a velocity of a motor, resulting in a reduced color registration error.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. An image forming apparatus comprising:

an image forming unit to form a color registration error detection pattern on a photoconductor;

a transfer unit to transfer the color registration error detection pattern formed on the photoconductor to a transfer belt;

a pattern sensing unit to sense the color registration error detection pattern transferred to the transfer belt;

a motor drive unit to drive a motor used to rotate the photoconductor;

a control unit to ascertain a gap change of the color registration error detection pattern, which denotes a periodic velocity change of the photoconductor, by sensing the color registration error detection pattern transferred to the transfer belt, and to change a velocity of the motor according to the gap change to reduce the periodic velocity change of the photoconductor;

a home-position sensing unit to sense a home-position of the photoconductor, wherein the control unit forms the color registration error detection pattern on the photoconductor on the basis of a time when the home-position of the photoconductor is sensed.

2. The image forming apparatus according to claim 1, wherein the photoconductor has a home-position detection protrusion used to detect the home-position of the photoconductor; and the home-position sensing unit senses the home-position of the photoconductor using the home-position detection protrusion.

3. The image forming apparatus according to claim 1, wherein a length of the color registration error detection pattern is an integer multiple of a circumferential length of the photoconductor.

4. An image forming apparatus comprising:

an image forming unit to form a color registration error detection pattern on a photoconductor;

a transfer unit to transfer the color registration error detection pattern formed on the photoconductor to a transfer belt;

a pattern sensing unit to sense the color registration error detection pattern transferred to the transfer belt;

a motor drive unit to drive a motor used to rotate the photoconductor;

a control unit to ascertain a gap change of the color registration error detection pattern, which denotes a periodic velocity change of the photoconductor, by sensing the color registration error detection pattern transferred to the transfer belt, and to change a velocity of the motor according to the gap change to reduce the periodic velocity change of the photoconductor;

a home-position sensing unit to sense a home-position of the photoconductor, wherein, if the home-position of the photoconductor is sensed while changing the velocity of the motor according to the gap change, the motor velocity change is reset and restarted by the control unit, to prevent error accumulation.

5. The image forming apparatus according to claim 1, wherein the control unit performs the ascertainment of the gap change, caused by the periodic velocity change of the photoconductor, after power on or off, after exchange or reinstallation of a developing device including the photoconductor, and/or after printing of predetermined number of recording media.

6. The image forming apparatus according to claim 1, wherein the control unit calculates a motor velocity function in the form of a sine function corresponding to the gap change after the ascertainment of the gap change, and changes the velocity of the motor according to the motor velocity function.

7. The image forming apparatus according to claim 6, wherein the control unit limits a phase of the motor velocity function so as to be less than ⅛ of a rotation cycle of the photoconductor.

8. The image forming apparatus according to claim 1, wherein the photoconductor comprises a plurality of photoconductors, on which color registration error detection patterns of different colors are formed, respectively;

a plurality of motors rotate the plurality of photoconductors, respectively; and the control unit individually rotates the plurality of photoconductors.

9. The image forming apparatus according to claim 8, wherein the control unit performs an Auto Color Registration (ACR) operation for the respective color registration error detection patterns of different colors formed on the plurality of photoconductors and thereafter, performs an ACR operation for overlapped color images of the color registration error detection patterns transferred to the transfer belt.

10. A control method of an image forming apparatus comprising:

forming a color registration error detection pattern on a photoconductor;

transferring the color registration error detection pattern formed on the photoconductor to a transfer belt;

sensing the color registration error detection pattern transferred to the transfer belt;

ascertaining a gap change of the color registration error detection pattern, which denotes a periodic velocity change of the photoconductor; and changing a velocity of a motor used to rotate the photoconductor according to the gap change, wherein the formation of the color registration error detection pattern on the photoconductor is performed on the basis of a time when a home-position of the photoconductor is sensed.

11. The control method according to claim 10, wherein the formation of the color registration error detection pattern on the photoconductor is performed during constant-velocity driving of the motor.

12. The control method according to claim 10, wherein the ascertainment of the gap change from gap differences of the color registration error detection pattern includes estimating the gap change via model fitting of the gap differences.

13. The control method according to claim 10, wherein the change of the velocity of the motor according to the gap change includes calculating a linear velocity function of the photoconductor from the gap change, calculating a motor velocity function from the linear velocity function of the photoconductor, and changing the velocity of the motor according to the motor velocity function.

14. A control method of an image forming apparatus comprising:

forming a color registration error detection pattern on a photoconductor;

transferring the color registration error detection pattern formed on the photoconductor to a transfer belt;

sensing the color registration error detection pattern transferred to the transfer belt;

ascertaining a gap change of the color registration error detection pattern, which denotes a periodic velocity change of the photoconductor; and changing a velocity of a motor used to rotate the photoconductor according to the gap change, wherein the change of the velocity of the motor according to the gap change includes calculating a linear velocity function of the photoconductor from the gap change, calculating a motor velocity function from the linear velocity function of the photoconductor, and changing the velocity of the motor according to the motor velocity function, and the linear velocity function of the photoconductor is represented by the following equation if the gap change is a sine function: Photoconductor Linear Velocity Function=$Vo+\omega A\cos(\omega t+\theta)$, where Vo is an average velocity of the photoconductor, A is a change magnitude, $\omega$ is an angular velocity $2\pi f$, f is a velocity change frequency, and $\theta$ is a phase.

15. The control method according to claim 14, wherein the motor velocity function is represented by the following equation: Motor Velocity Function=$Vm+\omega AVm/Vo*\sin(\omega t+\theta m)$, where Vm is the velocity of the motor that provides an average velocity of the photoconductor, A is a change magnitude, $\omega$ is an angular velocity $2\pi f$, f is a velocity change frequency, and $\theta m$ is a motor velocity phase.

16. The control method according to claim 15, wherein the motor velocity phase of the motor velocity function is less than ⅛ of a rotation cycle of the photoconductor.

17. The control method according to claim 10, wherein a plurality of photoconductors is provided, on which color registration error detection patterns of different colors are formed respectively, and a plurality of motors is provided to rotate the plurality of photoconductors respectively; and the control method further comprises individually rotating the plurality of photoconductors when the color registration error detection patterns are formed on the plurality of photoconductors.

18. The control method according to claim 17, further comprising performing an Auto Color Registration (ACR) operation for the respective color registration error detection patterns of different colors formed on the plurality of photoconductors and thereafter, performing an ACR operation for overlapped color images of the color registration error detection patterns transferred to the transfer belt.

19. A method of reducing color registration error in an image forming apparatus comprising:

determining a gap change of a color registration error detection pattern caused by a linear velocity change of a photoconductor; and performing an Auto Color Registration (ACR) operation for an image formed on the photoconductor to reduce the linear velocity change of the photoconductor based on a relationship between the gap change and a velocity of a motor, wherein the ACR operation comprises (a) driving the motor at a constant velocity;

(b) confirming if a home-position of the photoconductor is sensed;

(c) forming the color registration error detection pattern on the photoconductor;

(d) transferring the color registration error detection pattern formed on the photoconductor to an intermediate transfer belt;

(e) sensing the color registration error detection pattern transferred to the intermediate transfer belt;

(f) determining if operations (a)-(e) are repeatedly performed a predetermined number of times or more;

(g) calculating a gap difference between the bar-shaped patterns of the color registration error detection pattern if implementation of the operations (a)-(e) is determined to have been performed a predetermined number of times or more;

(h) fitting the calculated gap difference of the color registration error detection pattern using model fitting to approximate the gap difference to a sine function;

(i) estimating an amplitude and a phase of a gap change function via the fitting operation;

(j) calculating a linear velocity of the photoconductor using the estimated amplitude and phase of the gap change function;

(k) calculating a velocity of the motor using the calculated linear velocity of the photoconductor; and (l) changing the velocity of the motor based on the calculated velocity of the motor.

20. The method according to claim 19, wherein the linear velocity of the photoconductor is represented by the following equation: Photoconductor Linear Velocity Function=$Vo+\omega A\cos(\omega t+\theta)$, where Vo is an average velocity of the photoconductor, A is a change magnitude, $\omega$ is an angular velocity $2\pi f$, f is a velocity change frequency, and $\theta$ is a phase.

21. The method according to claim 20, wherein the motor velocity is represented by the following equation: Motor Velocity Function=$Vm+\omega AVm/Vo*\sin(\omega t+\theta m)$, where Vm is the velocity of the motor that provides an average velocity of the photoconductor, A is a change magnitude, $\omega$ is an angular velocity $2\pi f$, f is a velocity change frequency, and $\theta$ m is a motor velocity phase.

22. The method according to claim 21, wherein the motor velocity phase of the motor velocity function is less than ⅛ of a rotation cycle of the photoconductor.

* * * * *

UNITED STATES PATENT AND TRADEMARK OFFICE

CERTIFICATE OF CORRECTION

PATENT NO. : 8,526,867 B2
APPLICATION NO. : 12/926056
DATED : September 3, 2013
INVENTOR(S) : Hyun Ki Cho et al.

It is certified that error appears in the above-identified patent and that said Letters Patent is hereby corrected as shown below:

In the Claims:

In Column 14, Line 31, In Claim 14, delete "Vo+ωA cos(ωt+θ)," and insert -- Vo+ωAcos(ωt+θ), --, therefor.
In Column 16, Line 12 (Approx.), In Claim 20, delete "ωA cos(ωt+θ)," and insert -- ωAcos(ωt+θ), --, therefor.
In Column 16, Line 20, In Claim 21, delete "θ m" and insert -- θm --, therefor.

Signed and Sealed this
Eleventh Day of February, 2014

Michelle K. Lee

Michelle K. Lee
*Deputy Director of the United States Patent and Trademark Office*